United States Patent [19]

Popper

[11] 4,315,817

[45] Feb. 16, 1982

[54] VIBRATING SURFACE APPARATUS

[75] Inventor: Jakhin B. Popper, Kyriat Motzkin, Israel

[73] Assignee: Popper Engineering Ltd., Kyriat Motzkin, Israel

[21] Appl. No.: 912,886

[22] Filed: Jun. 5, 1978

[51] Int. Cl.[3] ..... B07B 1/42

[52] U.S. Cl. ..... 209/315; 209/365 B; 209/365 C; 74/26; 74/61; 198/766

[58] Field of Search ..... 209/415, 325, 329, 368, 209/365 A, 365 B, 315, 365 C, 367, 437, 447; 198/766, 767, 769, 770; 74/61, 26; 266/128

[56] References Cited

U.S. PATENT DOCUMENTS

| | | | |
|---|---|---|---|
| 2,610,726 | 9/1952 | Howard | 198/766 X |
| 2,899,044 | 8/1959 | Allen | 198/770 X |
| 3,226,989 | 1/1966 | Robins | 209/367 X |
| 3,251,457 | 5/1966 | Dumbaugh | 198/770 X |
| 3,253,701 | 5/1966 | Evans | 209/367 X |
| 3,317,041 | 5/1967 | Century | 209/315 |
| 3,650,401 | 3/1972 | Riesbeck | 209/368 |
| 4,015,705 | 4/1977 | Dumbaugh | 198/770 |
| 4,062,768 | 12/1977 | Elliott | 209/365 A |

FOREIGN PATENT DOCUMENTS

| | | | |
|---|---|---|---|
| 855353 | 11/1952 | Fed. Rep. of Germany | 209/365 B |
| 972488 | 11/1959 | Fed. Rep. of Germany | 74/61 |
| 57074 | 7/1934 | Netherlands | 209/329 |
| 108569 | 2/1966 | Norway | 198/770 |
| 381779 | 10/1932 | United Kingdom . | |
| 911895 | 3/1959 | United Kingdom | 198/766 |

*Primary Examiner*—Robert Halper
*Attorney, Agent, or Firm*—Sandler & Greenblum

[57] ABSTRACT

Vibrating surface apparatus comprising a base member, vibratory motion producing member, a first spring coupling the vibratory motion producing member to the base member; a first surface adapted to be vibrated; a second spring coupling said surface to the vibratory motion producing member; and a third spring coupling the surface to the base member.

6 Claims, 4 Drawing Figures

VIBRATING SURFACE APPARATUS

The present invention relates to vibrating trays and screens and to vibrating surfaces generally.

Many types of vibrating screens and trays are known in the art. Two examples of such apparatus are illustrated in U.S. Pat. Nos. 3,180,158 and 3,348,664. Conventional vibrating systems of this type involve a number of deficiencies. Firstly, the operation of such apparatus often involves the transmission of vibrations to the vicinity of the apparatus often causing disturbance and also resulting in constructional difficulties and constraints in the environment of the apparatus. This difficulty can be overcome sometimes at significant expense by mounting such apparatus on very soft springs. Alternatively, such apparatus may be mounted on a relatively heavy base or dynamic dampers, i.e. spring-mounted auxiliary masses tuned to the frequency of the vibrations produced during operation, may be employed.

Further difficulties arise in connection with the operation of the drive for such vibrating apparatus which requires heavy duty bearing power transmissions and mounts to cope with the large loads. Yet another difficulty involves damping of the vibrations under large loads. It is particularly desirable that the frequency and amplitude of the vibrations not vary significantly as a function of load within designed limits and that such designed limits be as broad as possible. Additionally most such vibrating surface apparatus is supported on relatively strong and high rate springs such as relatively expensive coil springs or a large number of leaf springs. This requirement adds significantly to the cost of such apparatus.

The present invention seeks to overcome the above disadvantages and provides vibrating surface apparatus comprising:

a base member;

vibratory motion producing means;

first spring means coupling said vibratory motion producing means to said base member;

a surface adapted to be vibrated;

second spring means coupling said surface to said vibratory motion producing means; and third spring means coupling said surface to said base member.

Further in accordance with an embodiment of the invention there is provided driving apparatus for a vibrating system having a surface adapted to be vibrated and a fixed base comprising:

vibratory motion producing means;

first spring means coupling said vibratory motion producing means to said base member;

second spring means coupling said surface to be vibrated to said vibratory motion producting means; and third spring means coupling said surface to said base member.

The invention will be more fully understood and appreciated from the following detailed description taken in conjunction with the drawings in which.

Figure 1:
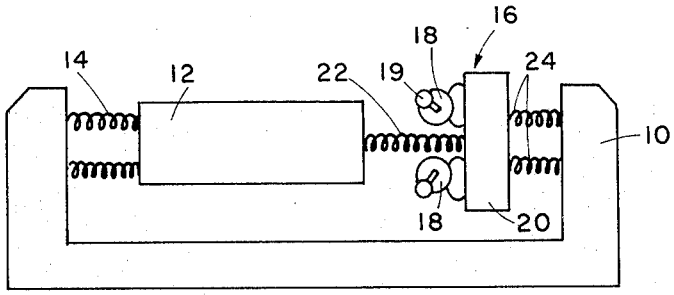
FIG. 1 is a schematic illustration of a vibrating tray constructed and operative in accordance with an embodiment of the invention.

Referring now to FIG. 1 there is shown a schematic illustration of a vibrating table comprising a base 10 and a tray 12 which is coupled to base 10 via spring means 14. Means for producing vibratory motion 16, typically comprising one or more motors 18 are driving a mass 19 in eccentric motion and a mounting member 20 onto which the motors are affixed, is coupled to tray 12 by spring means 22. Vibratory motion producing means 16 is also coupled to base 10 by means of spring means 24. It should be appreciated that spring means 14, 22 and 24 each may comprise any desired number of springs which together have operational characteristics which will be described hereinafter in greater detail.

For the purpose of discussion and later identification the following references henceforth will be employed. The spring constant of spring means 22 will be referred to as $k_1$, the spring constant of spring means 14 will be referred to as $k_2$ and the spring constant of spring means 24 will be referred to as $k_0$.

The condition under which substantially no vibrational forces are transmitted to the base is maintained when:

$$k_2/k_0=\eta \tag{1}$$

where $$\eta=a/A \tag{2}$$

where a is the amplitude of vibration of vibration producing means 16 and

A is the amplitude of vibration of tray 12.

In order that the desired value for $\eta$ is obtained, $k_1$ is selected according to the following equation:

$$k_1=\frac{\frac{W}{\delta}-k_2}{1+\eta} \tag{3}$$

where W is the nominal weight of the tray and $$\delta=\frac{g\times 900}{\pi^2 n^2} \tag{4}$$

where g=the gravitational acceleration of the earth and n=the rate of rotation of the driving motors 18 in units of r.p.m.

Driving motors 18 may be ordinary motors coupled to relatively small eccentric weights.

The total static moment of the eccentric weights 19 determines the amplitude of the tray by the following expression:

$$\Sigma Wr-A\delta k_1(1-\epsilon\eta) \tag{5}$$

where $\eta$ is the displacement of the center of gravity of the weight from the axis of rotation thereof.

Thus as long as $\epsilon\eta$ is less than 1, relatively small weights may be employed, thus enabling standard motors having ordinary bearings to be used.

Since $\eta$ is non-zero the mounting support 20 vibrates at a non-aero amplitude, a, thus synchronising the motors, in the case that more than one motor is used, and producing a relatively simple drive mechanism.

The value $\epsilon$ is governed by the following expression:

$$\epsilon = \frac{\frac{W_B}{\delta} - k_0}{k_1} \tag{7}$$

where $W_B$ is the total weight of the vibratory motion producing means 16 including mounting member 20, motors 18, and eccentric weights 19.

The quantity $\epsilon$ also governs the change in amplitude of the tray as a function of increase in the load on the tray.

The increase in amplitude $A_1$ is given by the following expression:

$$A_1 = A \frac{1 - \epsilon\eta}{1 - \epsilon[\frac{W_1}{\delta k_1} - \frac{k_2}{k_1} - 1]} \tag{8}$$

subject to the condition that $$0 < \epsilon[\frac{W_1}{\delta k_1} - \frac{k_2}{k_1} - 1] < 1$$

Figure 2:
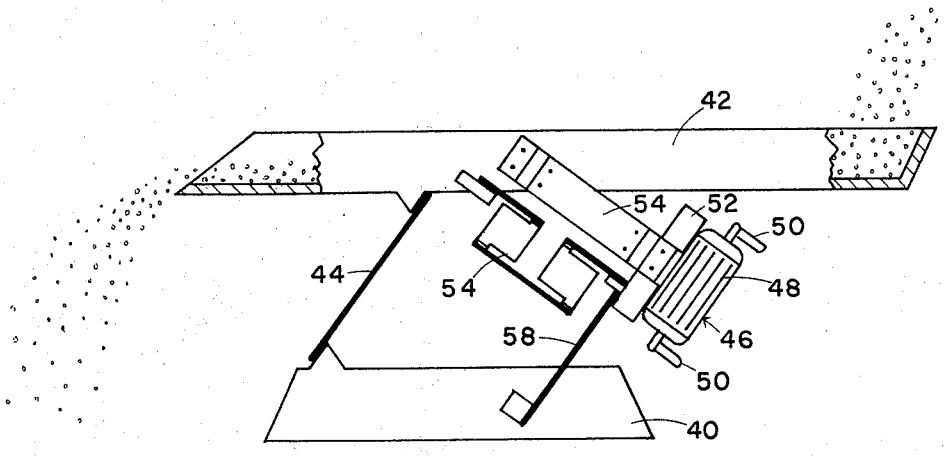
FIG. 2 is a schematic illustration of a vibrating tray constructed and operative in accordance with another embodiment of the invention.

Reference is now made to FIG. 2 which shows a vibrating tray constructed and operative in accordance with a preferred embodiment of the invention and comprising a base 40 onto which is coupled a tray 42 via a leaf spring 44 having a spring constant $k_2$. Vibratory motion producing means 46, comprising one or two electric motors 48 associated with eccentric weights 50 and mounted on a support panel 52, is coupled to tray 42 by a pair of perpendicularly oriented springs $S_4$ of spring constant $k_1$. These springs are fully described in the earlier German Offenlegungsschrift No. 27 21 399, published Nov. 24, 1977. Vibratory motion producing means 48 is also coupled to base 40 by means of a leaf spring 58 having a spring constant $k_0$.

In practice it is desirable to keep $k_0$ and $k_2$ relatively small so that a possible deviation from the equality set forth in equation 1 hereinabove should not result in large forces. It follows from equations 3 and 7 that $k_1$ must be relatively large. Thus it is desirable to employ springs as described in German Offenlegungsschrift No. 27 21 399 for this purpose in order to efficiently support the tray and the vibratory motion producing means with a minimum of expensive springs.

The base may be made of soft rubber pads if it is comparatively heavy or alternatively it may be attached rigidly to a supporting floor surface.

Where the base is made of soft rubber pads it may be suspended on springs from above or below. In such a case, in order for the vibrating system to function in a desired manner i.e. having a large ratio A/a, it is necessary to select $k_2$ to be greater than or equal to $\eta k_0$. In the second case where the base is made relatively light and is fixed to the supporting floor it is desirable to select $k_2$ to be less than or equal to $\eta k^0$.

It is to be understood that the weight of the vibrating system affects its cost and the related problems of transport and mounting.

It follows from equation 3 hereinabove that the value of $k_1$ is an increasing function of the weight of the tray. Thus once the desired amplitude A and frequency n of tray vibration have been selected the required quantity of spring steel becomes proportional to $k_1$. It follows from equation 7 that a large $k_1$ requires a relatively large mounting member weight $W_B$, thus increasing the total weight of the system.

Figure 3:
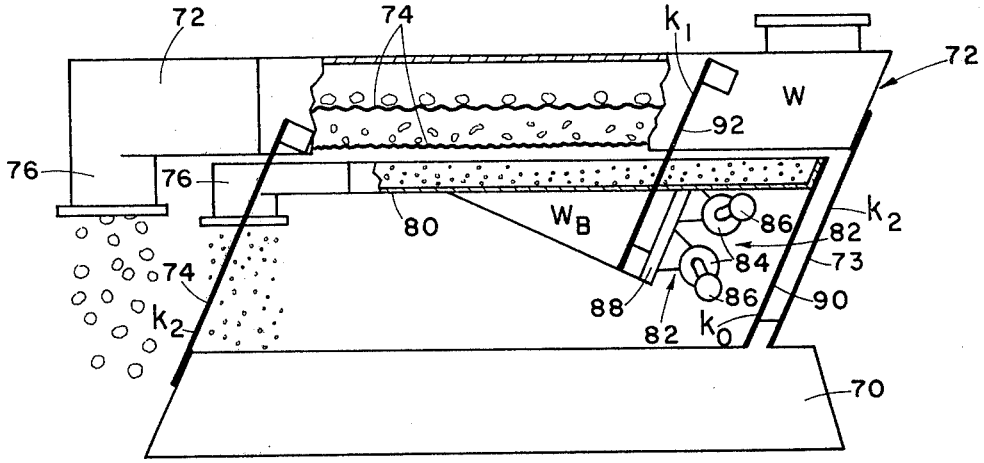
FIG. 3 is a schematic side view illustration of sorting apparatus constructed and operative in accordance with an embodiment of the invention.
Figure 4:
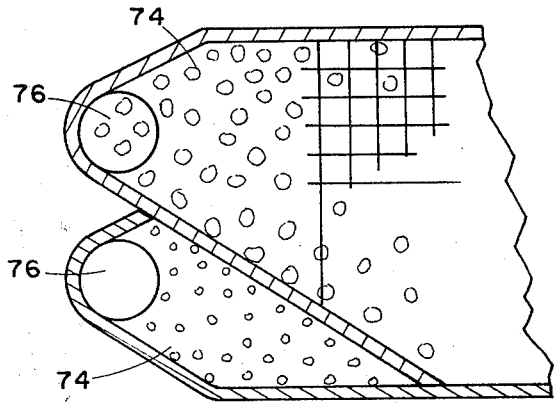
FIG. 4 is an illustration of a detail of the apparatus of FIG. 3 showing the relative arrangement of two sorting surfaces thereof and the exits therefrom.

On the basis of the above criteria it is seen to be desirable to construct a vibrating screen sorter device as illustrated in FIGS. 3 and 4. The sorter comprises a base 70 onto which is mounted, by means of springs 73 and 74 of spring constant $k_2$, a structure 72. Structure 72 comprises one or a plurality of generally superimposed screens 74 each having its own outlet 76. As seen more clearly in FIG. 4 the outlets of the respective screens may be laterally displaced from one another so as to permit a plurality of such screens to be generally superimposed within the structure 72. It is appreciated that the fineness of the mesh of the respective screen increases from the upper to the lower screens. A collection trough 80 for the smallest particles is fixedly attached to vibratory motion producing means 82 comprising one or more motors 84 driving eccentric weights 86 and mounted on a mounting member 88. Trough 80 and means 82 are mounted onto base 70 by means of a leaf spring 90 of spring constant $k_0$ and also coupled to structure 72 by means of a spring 92 of spring constant $k_1$.

It is appreciated that according to an alternative embodiment of the apparatus illustrated in FIGS. 3 and 4 a plurality of screens may alternatively be incorporated in addition to or in place of trough 80 and be fixedly coupled to means 82. Thus it is appreciated that the required weight $W_B$ may be realized in the form of trays, screens or troughs thereby producing counter-vibrating surfaces as desired.

It is to be understood that all the equations and inequalities set forth hereinabove are not necessarily precisely exact but are rather engineering approximations to the various physical situations.

It will be appreciated by persons skilled in the art that many alternative embodiments of the apparatus shown herein may also be constructed in accordance with the teachings of the present invention. The embodiments illustrated and described herein are merely exemplary and do not limit the invention which is defined only by the claims which follow.

I claim:

1. Vibratory surface apparatus comprising:

a fixed base member;

vibratory motion producing means vibrating axially along a vibratory axis;

first spring means coupling said vibratory motion producing means to said base member;

a first surface adapted to be vibrated along said vibratory axis;

second spring means drivingly coupling said first surface to said vibratory motion producing means, said second spring means having a finite spring constant along said vibratory axis thereby permitting substantial differential motion between said vibratory motion producing means and said first surface along said vibratory axis; and third spring means coupling said first surface to said base member; the spring constants of said first, second and third spring means being selected such that substantially no vibrational forces are transmitted to said base member and such that said first, second and third spring means do not produce appreciable damping.

2. Apparatus according to claim 1 wherein the spring constant of said first spring means is $k_0$; the spring constant to said second spring means is $k_1$ and the spring constant to said third spring means is $k_2$ and wherein the ratio $$\eta = \frac{k_2}{k_0} = \text{the ratio of the } \frac{\text{amplitude of vibrating of said vibrating producing means}}{\text{amplitude of vibration of said first surface}}$$

3. Apparatus according to claim 2 wherein the spring constant $k_1$ is governed by the following equation:

$$k_1 = \frac{\frac{W}{\delta} - k_2}{1 + \eta}$$

where

W is the nominal weight of said first surface and $$\delta = \frac{g \times 900}{\pi^2 n^2}$$

where g = the gravitational acceleration of the earth and n = the rate of rotation of the driving motors in units of r.p.m.

4. Vibrating surface apparatus according to claim 1 wherein said surface to be vibrated comprises at least one screen mesh, said vibrating surface apparatus also comprising a second surface adapted to be vibrated fixedly attached to said vibratory motion producing means for vibration together therewith.

5. Vibrating surface apparatus according to claim 4 and constituting a sorter wherein said first and second surfaces adapted to be vibrated comprise a plurality of superimposed screens.

6. Driving apparatus for a vibrating system having a surface adapted to be vibrated and a fixed base comprising:

vibratory motion producing means vibrating axially along a vibratory axis;

first spring means coupling said vibratory motion producing means to said base;

second spring means coupling said surface to be vibrated to said vibratory motion producing means for axial motion along said vibratory axis, said second spring means having a finite spring constant along said vibratory axis thereby permitting substantial differential motion between said vibratory motion producing means and said first surface along said vibratory axis; and third spring means drivingly coupling said first surface to said base member;

the spring constants of said first, second and third spring means being selected such that substantially no vibrational forces are transmitted to said base member and such that said first, second and third spring means do not produce appreciable damping.

* * * * *